United States Patent [19]

Schulz

[11] 3,993,728

[45] Nov. 23, 1976

[54] BIDENTATE ORGANOPHOSPHORUS SOLVENT EXTRACTION PROCESS FOR ACTINIDE RECOVERY AND PARTITION

[75] Inventor: Wallace W. Schulz, Richland, Wash.

[73] Assignee: The United States of America as represented by the United States Energy Research and Development Administration, Washington, D.C.

[22] Filed: Aug. 27, 1975

[21] Appl. No.: 608,378

[52] U.S. Cl. ..... 423/9; 423/10

[51] Int. Cl.[2] ..... B01D 11/00

[58] Field of Search ..... 423/9, 10

[56] References Cited

UNITED STATES PATENTS 3,243,254 3/1966 Siddall ..... 423/10 X

OTHER PUBLICATIONS

Butler, F. E. et al., "Determination of Actinides in Biological Samples with Bidentate Organophosphorous Extractant," In Anal. Chem., 42(9):1073–1076, Aug., 1970.

*Primary Examiner*—Richard E. Schafer

*Attorney, Agent, or Firm*—Dean E. Carlson; Robert M. Poteat

[57] ABSTRACT

A liquid-liquid extraction process for the recovery and partitioning of actinide values from acidic nuclear waste aqueous solutions, the actinide values including trivalent, tetravalent and hexavalent oxidation states is provided and includes the steps of contacting the aqueous solution with a bidentate organophosphorous extractant to extract essentially all of the actinide values into the organic phase. Thereafter the respective actinide fractions are selectively partitioned into separate aqueous solutions by contact with dilute nitric or nitric-hydrofluoric acid solutions. The hexavalent uranium is finally removed from the organic phase by contact with a dilute sodium carbonate solution.

12 Claims, No Drawings

BIDENTATE ORGANOPHOSPHORUS SOLVENT EXTRACTION PROCESS FOR ACTINIDE RECOVERY AND PARTITION

BACKGROUND OF THE INVENTION

The invention described herein was made in the course of, or under a contract with the U.S. Energy Research and Development Administration.

The present invention relates to liquid-liquid solvent extraction processes and more particularly to a liquid-liquid solvent extraction process for the recovery and partitioning of actinide values from acidic nuclear waste aqueous solutions.

Heretofore extensive research and development have gone into finding ways to remove or recover actinide values from acidic nuclear waste aqueous solutions which are generated at fuel reprocessing sites, such as at the Hanford facility near Richland, Washington. Currently at Hanford, a 30 volume percent di-n-butyl-butyl-phosphonate (DBBP) - carbon tetrachloride ($CCl_4$) extractant is used to extract americium(III) and plutonium(IV) values from acid (~ 2 M $HNO_3$) aqueous raffinate waste streams generated in Plutonium Reclamation Facility Operations. (The Plutonium Reclamation Facility also uses a 20 percent tri-n-butylphosphate (TBP) - ($CCl_4$ solvent to recover from $HNO_3$ and $HNO_3$—HF solutions plutonium values from a wide variety of unirradiated metallurgical scrap forms.) Satisfactory operation with the DBBP extractant requires on-line neutralization of the highly-salted, unbuffered waste stream to 0.1 M $HNO_3$. Neutralization of the unbuffered acidic aqueous raffinate (CAW) solution to the correct pH range is difficult to control. Moreover, even with the feed adjusted to the proper acidity, the present DBBP process only recovers 50 to 60% of the americium in the acidic aqueous raffinate (CAW) solution. There is thus a strong need for a more efficient process capable of extracting both americium and plutonium directly from the acid CAW solution.

There is also an increasing need for an efficient, continuous countercurrent liquid-liquid extraction process to remove all actinides from Purex process high-level waste solutions generated in reprocessing of irradiated power reactor fuels. The small concentrations of long-lived actinides normally present in such solutions require that the high-level waste, after solidification and conversion to a virtually insoluble final product, be stored for tens of centuries to protect the public from biologically hazardous exposure. With actinide removal, however, the large bulk of the relatively short-lived fission products need be stored for only hundreds of years before becoming innocuous. The isolated actinides can then either be suitably stored as a very small volume of high-level waste or, more desirably, returned to the nuclear fuel cycle.

Solvent extraction processes known heretofore for removal of americium and curium from Purex process high-level waste all involve complicated denitration and pH adjustment operations and, in some cases, the use of buffering and complexing agents.

In the early 1960's Siddall reported on the extraction of trivalent americium, promethium and cerium from aqueous nitric acid solutions by neutral bidentate organophosphorus extractants, including methylene diphosphonates, carbamyl phosphonates and carbamylmethylene phosphonates. For a more complete description of this process see U.S. Pat. No. 3,243,254 issued March 1966 to T. H. Siddall, III. In the ensuing years neither Siddall or others have demonstrated a practicable bidentate extraction process for recovery and partitioning of all of the actinides, which are in the +3, +4 and +6 oxidation state, that are present in acidic nuclear waste solutions, especially the high-level Purex process waste solutions generated in reprocessing of irradiated power reactor fuels.

It is therefore an object of this invention to provide a method of recovering and partitioning actinide values from acidic nuclear waste aqueous solutions.

Another object is to provide a method of separating actinide values, such as Am(III), Cm(III), Pu(IV), Np(IV) and U(VI), directly from acidic nuclear waste aqueous solutions.

Still another object of this invention is to provide a solvent extraction process for the recovery and partitioning of values which is amenable to remote, relatively trouble-free operation in plant-scale continuous countercurrent extraction equipment.

SUMMARY OF THE INVENTION

In accordance with the present invention I have discovered that bidentate organophosphorus compounds are efficient extractants of actinide values which are present in trivalent, tetravalent and hexavalent oxidation states in acidic nuclear waste aqueous solutions. With this method essentially all actinide values, e.g., Am(III), Cm(III), Pu(IV), Np(IV) and U(VI), are extracted into the organic phase and thereafter the actinides are selectively stripped into trivalent, tetravalent and hexavalent fractions by contact with dilute aqueous acids.

In one embodiment Am(III) and Pu(IV) are extracted from acidic waste solutions of approximately 2 M nitric with 30% extractant of dihexyl-N, N-diethylcarbamylmethylene phosphonate - carbon tetrachloride and thereafter about 90% of the Am(III) is stripped from the Am(III) - Pu(IV) - loaded organic phase with dilute (e.g., 0.1 M) nitric acid with the remaining Pu(IV) - loaded organic phase finally contacted with a dilute $HNO_3$ — HF solution to strip the Pu(IV) into the aqueous phase.

In another embodiment wherein Purex high-level acidic nuclear waste aqueous solutions containing Am(III), Cm(III), Pu(IV), Np(IV) and U(VI) are partitioned into trivalent, tetravalent and hexavalent fractions the method comprises contacting the acidic waste solution which is approximately 5 M in $HNO_3$ and which has been made approximately 0.05 M ferrous sulfamate with dihexyl-N, N-diethylcarbamylmethylene (DHDECMP) phosphonate-dodecane extractant whereby essentially all of the actinide values are extracted into the organic phase, contacting the actinide-loaded organic phase with dilute nitric acid to strip out the trivalent actinides, contacting the organic phase containing the tetravalent and hexavalent actinide values with a dilute aqueous solution of nitrichydrofluoric acid to strip out the tetravalent actinide values and thereafter washing the organic phase containing the hexavalent actinide values with a dilute solution of sodium carbonate to remove essentially all of the hexavalent actinide values from the organic phase which is then recycled to the extraction operation.

The present invention affords marked improvements in the recovery of Am(III) and Pu(IV), i.e., 95–99.9%, for waste streams from Hanford's Plutonium Reclamation Facility, as well as eliminating the need for careful in-line neutralization of the 2 M nitric acid aqueous raffinate (CAW) stream to about 0.1 M nitric acid. Batch and mixer-settler data show that both americium and plutonium values transfer rapidly into and out of the 30% dihexyl-N, N-diethylcarbamylmethylenephosphonate - carbon tetrachloride solutions.

Additionally, in the processing of Purex high-level acidic waste aqueous solutions containing Am(III), Cm(III), Pu(IV), Np(IV) and U(VI) as well as minor amounts of other rare earths and fission products the trivalent fraction of Am(III) and Cm(III) along with the rare earths is above about 99%, the tetravalent fraction of Pu(IV) and Np(IV) is above about 95% and the hexavalent fraction of U(VI) is above about 99% recovered.

The bidentate organophosphorus extractants employed in the present method were found to exhibit satisfactory radiolytic stability.

DESCRIPTION OF THE PREFERRED EMBODIMENT

While it will be understood by those skilled in the art that the present invention is equally applicable to extracting actinide values from acidic nuclear waste solutions, the invention will be hereinafter described with particular reference to (1) a process for recovering and purifying of gram-quantities of Am(III) and Pu(IV) from approximately 2 M nitric acid solutions which are compatible with presently installed Hanford Plutonium Reclamation Facility (PRF) solvent extraction equipment and other PRF Am and Pu processing steps, and (a) process for the direct removal of and partitioning of actinides from high-level Purex acidic (~ 5 M $HNO_3$) wastes solutions.

EXTRACTION OF AMERICIUM AND PLUTONIUM FROM ACID WASTE SOLUTIONS

The Hanford's Plutonium Reclamation Facility is operated to recover and purify plutonium from a wide variety of metallurgical scrap including metal, oxide and alloys. Heretofore the plutonium values were recovered by a reflux-type solvent extraction process using tributylphosphate as the extractant. Subsequently a DBBP solvent extraction process is utilized to recover and separate americium-plutonium values from neutralized (~ 0.1 M $HNO_3$) acidic aqueous waste (CAW) solution. The DBBP process is performed in three packed pulse columns; under process conditions the extraction column is operated with three extraction and one scrub stages while the partition and plutonium strip columns are each operated with three stages. The present extraction process may be substituted for the DBBP process and advantageously eliminates the requirement of in-line neutralization of the acidic feed stock.

In the first step of the extraction process the acidic aqueous waste solution which is approximately 2 M nitric acid is contacted with an equal volume of a 30 volume % of DHDECMP-$CCL_4$ containing 0.015 M nitric acid whereby approximately 90–95% of the Am-(III) and about 99.5% of the Pu(IV) are co-extracted into the organic phase with about 5—10% of the Am-(III) and about 0.5% Pu(IV) remaining in the aqueous phase which is passed to underground storage.

The Am-Pu loaded organic phase which is about 0.5 M in nitric acid is then contacted with a small volume (about 1/3 that of organic phase) of 0.1 M $HNO_3$ whereby 80—90% of the americium and less than about 10% of the plutonium is stripped from the organic phase. The resultant aqueous stream which is 1.24 M $HNO_3$ is then purified by well-known ion exchange procedures.

The organic phase which is about 0.09 M nitric acid and contains about 10–15% Am is finally contacted with a small volume (about one-fourth that of the organic flow) of 0.1 M $HNO_3$ — HF aqueous solution whereby 90–95% of the Pu and 10–15% of Am is stripped into the aqueous phase which is about 0.3 M $HNO_3$. The resultant aqueous phase is returned to the tributylphosphate extraction process for recovery of plutonium values.

The organic phase from this second stripper which is about 0.015 M nitric acid is recycled to the extraction column for reuse in the initial solvent extraction operation.

Based upon limited data taken with synthetic acidic aqueous waste (CAS) solutions the extraction is postulated to be:

$$Am^{3+} + 3NO_3^- + 3DHDECMP \rightleftarrows Am(NO_3)_3 \cdot 3DHDECMP.$$

Regarding the bidentate organophosphorus extractants useful in this invention, compound types of those studied by Siddall are quite satisfactory; namely methylene diphosphonates $$[(RO-)_2\overset{O}{\overset{\|}{P}}-CH_2-\overset{O}{\overset{\|}{P}}(-OR)_2],$$

carbamylphosphonates $$[(RO-)_2\overset{O}{\overset{\|}{P}}-\overset{O}{\overset{\|}{C}}-N(-R)_2],$$

and carbamylmethylene diphosphonates $$[(RO-)_2\overset{O}{\overset{\|}{P}}-CH_2-\overset{O}{\overset{\|}{C}}-N(-R)_2].$$

The preferred solvent extractants are the carbamylmethylene diphosphonates — specifically dihexyl-N, N-diethylcarbamylmethylene phosphonate (DHDECMP) and its analogue, dibutyl -N, N-diethylcarbamylmethylene phosphonate (DBDECMP).

It should be noted that technical grade DHDECMP and DBDECMP both have been found to contain a small concentration of an impurity which has a great affinity for trivalent americium at low nitric acid concentrations. For certain flowsheet applications removal of this impurity is essential to permit partitioning of Am(III) from coextracted Pu(IV), Np(IV) and U(VI) with dilute nitric acid. Satisfactory purification of DBDECMP and DHDECMP may be accomplished by acid (HCl) hydrolysis at 60° C followed by alkaline washing. Alternatively, DBDECMP, but apparently not DHDECMP, can be readily purified by vacuum distillation procedures.

EXTRACTION OF ACTINIDES FROM PUREX PROCESS WASTE

In addition to being applicable to the extraction and recovery of Am(III) and Pu(IV) from acidic aqueous waste solutions of approximately 2 M nitric acid, the present invention is equally efficacious in the processing of high-level Purex-type waste solutions containing trivalent, tetravalent and hexavalent actinides by solvent extraction and partitioning. It will be appreciated by those skilled in the art that both for waste management purposes and for their own intrinsic worth, there is considerable current interest in processes for removal of actinides, i.e., elements 92–96, from high-level Purex process waste solutions.

In accordance with this embodiment a concentrated (~ 5M) high-level Purex waste solution which may be freshly produced or aged (i.e., 5–10 years) is first adjusted with a reducing agent such as ferrous sulfamate and heated to an elevated temperature, e.g., 55–60° C, to establish both Pu and Np in the tetravalent oxidation state. Where the waste solutions are stored on an interim basis for 5–10 years the short-lived radioiostopes are thus permitted to decay and the radiation dose to the DHDECMP solvent is decreased.

Subsequently, the adjusted acidic feed is contacted countercurrently with a 30 volume % DHDECMP in dodecane to extract into the organic phase all the actinides and lanthanides. Other long-lived radioisotopes, e.g., $^{137}Cs$ and $^{90}Sr$, will remain in the aqueous raffinate which is passed to an aqueous waste calcination and solidification operation for storage.

Following the extraction column, trivalent Am, Cm and lanthanides are partitioned from the coextracted Pu(IV), Np(IV) and U(VI) by contacting the organic extract which is about 0.5 M nitric acid with a small volume (approximately one-fourth of organic) of dilute (0.1 M) nitric acid. The Am-Cm - loaded fraction which is about 1.3 M in nitric acid contains better than 99% of the Am, Cm and the rare earths with only about 5% of the Pu and Np. This trivalent fraction is then processed by conventional techniques (e.g., pressurized ion exchange) to separate the Am-Cm from the rare earths.

The organic phase which is about 0.1 M in nitric acid and contains essentially all of the U(VI) and about 95% of the Pu(IV) and Np(IV) along with less than 1% of the fission products is then contacted in a third (strip) column with a small volume (about 1/5 the organic) of dilute 0.1 M $HNO_3$ — HF solution to preferentially strip (Pu(IV) and Np(IV). The Pu — Np loaded fraction which is about 0.3 M $HNO_3$ and 0.1 M HF contains about 95% of the Pu(IV) and Np(IV). This tetravalent fraction is processed by conventional techniques such as by anion exchange to recover and separate the Pu and Np from each other and other contaminants in the aqueous solution.

Finally, the DHDECMP extractant is washed with dilute $Na_2CO_3$ solution to remove U(VI) and trace amounts of other constituents not removed in earlier columns.

To minimize solvent radiolysis and degradation, each of the process steps should preferably be performed in short-residence time contactors. In plant-scale Hanford Plutonium Reclamation Facility operation the DHDECMP solvent inventory would be expected to receive alpha radiation at a rate of about 0.01 to 0.05 watt-hr/liter per extraction cycle. The dose rate to the solvent would, of course, be dependent upon the amount of Am and the amount and isotopic composition of the plutonium in the waste. Approximately eight extraction cycles are completed per day or 40 per 5-day work-week. Preliminary results to date show that irradiation doses as high as 10.6 watts-hr/liter do not adversely affect the Am(III) extraction - strip behavior of a 30% volume percent DHDECMP solvent. Accordingly, it would appear that in the present invention the DHDECMP solvent will have a long, useful life.

Having described the invention in a general fashion the following examples are given by way of illustration to further describe in greater detail the particulars of the present solvent extraction and partitioning process.

EXAMPLE I

To demonstrate the feasibility of extracting americium and plutonium from acidic aqueous solutions with a 30% DHDECMP-$CCl_4$ solvent the following experiments were performed.

Approximately 200 liters of DHDECMP (commercially available from the Wateree Chemical Company) were obtained. Extractants containing 30 vol. % DHDECMP were prepared by diluting as-received DHDECMP with either reagent-grade $CCl_4$ or technical - grade 1, 2, 4 - trichlorobenzene (TCB) (J. T. Baker Chemical Company). Due to impurities present in the as-received DHDECMP the extractants were purified by contacting the organic solutions with 6 M HCl at 60° C for 24 to 48 hours and then washing the resulting organic phase at 25° C with equal-volume portions of 1 M NaOH, 1 M $HNO_3$ and water. This particular hydrolysis - wash procedure yielded water-white extractant (specific gravity = 1.403) with reproducible and usable Am-Pu extraction - strip characteristics. The volume of HCl-hydrolyzed DHDECMP extractants decreased about 10% when such the extractants were washed with 1 M NaOH. For convenience, the extractant compositions refer to the volume percent of DHDECMP present prior to hydrolysis and washing.

Actual acidic aqueous waste (CAW) solutions (Table I) were used in distribution ratio tests in mixer-settler batch contacts. Others were made with synthetic CAW solution (Table I) spiked with either $^{241}Am$ or Am-free plutonium.

TABLE I

| COMPONENT | CONCENTRATION ACTUAL, M | SYNTHETIC, M |
|---|---|---|
| $HNO_3$ | 2.23 | 1.7 |
| Al | 0.84 | 0.82 |
| Na | 0.52 | — |
| F | ~0.3[a] | 0.3 |
| Fe | 0.009 | — |
| Si | 0.0017 | — |
| Ca | 0.0012 | — |
| Cr | 0.0007 | — |
| Mg | 0.0006 | 0.01 |
| Ni | 0.0003 | — |
| Pu | 0.013[b] | — |
| $^{241}Am$ | 0.0021[b] | — |

[a]estimated concentration
[b]concentration given in g/liter

The mixer-settlers had six stages and were Hanford-designed versions of a type described more fully in *Chem. Eng. Progr.*, 50:403 (1959), B. W. Coplan et al. The mixer-settlers were operated with the particular aqueous and organic solutions required until steady-state conditions were reached. Samples of the effluent streams were taken hourly and analyzed to determine when steady-state was attained. Americium and plutonium losses and decontamination factors for various impurities were computed from analyses of steady-state effluent streams. Organic product solution collected under steady-state conditions in extraction and partition column runs, respectively, were used as feed solutions in succeeding partition and plutonium strip column runs. Mixer-settler runs generally lasted 6 to 8 hr., and organic solutions containing americium and/or plutonium stood 16 to 24 hr. at 25° C before use in a partition or strip column run. Actual acidic aqueous waste (CAW) solution was used in most extraction column runs; however, to provide feed for some partition and strip column tests, a few runs were made with synthetic CAW solution spiked with Am-free plutonium.

Organic DHDECMP - diluent solutions were contacted with equal-volume portions of 0.1 to 5.0 M $HNO_3$ — 0.0 to 1 M $Al(NO_3)_3$ — 0 to 0.25 M HF solutions containing about 0.01 g/liter $^{241}Am$ or 0.01 to 0.05 g/l Pu.

The resulting solutions were analyzed for $HNO_3$ and either americium or plutonium. Prior to contact with the aqueous americium or plutonium, organic solvents were contacted twice with fresh equal-volume portions of appropriate $HNO_3$ — $Al(NO_3)_3$ — HF solutions.

Kinetics of extraction of americium and plutonium were determined by contacting, for various times at 25° C, an aqueous 2 M $HNO_3$ — 0.75 M $Al(NO_3)_3$ solution containing either 0.01 g/liter $^{241}Am$ or 0.05 g/liter Am-free plutonium with an equal volume of 30% DHDECMP - $CCl_4$ which had previously equilibrated with 2 M $HNO_3$ — 0.75 M $Al(NO_3)_3$ solution. Portions of the Am- and Pu-loaded organic phases obtained after a five-minute extraction contact were then contacted for various times at 25° C with equal volumes of 0.1 M $HNO_3$ and 0.1 M $HNO_3$ — 0.1 M HF, respectively, to measure rates of stripping of the two actinides. Prior to contact with 0.1 M $HNO_3$ — 0.1 M HF solution the Pu-loaded organic phase was contacted with an equal volume of 0.1 M $HNO_3$ to strip $HNO_3$. To standardize conditions, rate measurements were made using one stirrer motor operated at constant speed. Phases obtained in kinetic measurements were separated within a few seconds by centrifugation and analyzed for either $^{241}Am$ or plutonium.

Detailed equilibrium data for the extraction of americium, plutonium and $HNO_3$ from $HNO_3$ — $Al(NO_3)_3$—HF solutions by purified 30% DHDECMP-$CCl_4$ or (TCB) extractants are given in Tables II, III and IV below:

TABLE II

EQUILIBRIUM DATA FOR EXTRACTION OF AMERICIUM AND $HNO_3$ BY 30% DHDECMP-$CCl_4$[a]

| Equilibrium Aqueous Phase | | | Equilibrium Organic Phase | | Distribution Ratios | |
|---|---|---|---|---|---|---|
| $Al(NO_3)_3$ M | $HNO_3$ M | $^{241}Am$ μCi/ml | $HNO_3$ M | Am μCi/ml | $D_{Am}$ | $D_{HNO_3}$ |
| 0.0 | 0.144 | 44.0 | 0.0058 | 0.661 | 0.0145 | 0.040 |
| 0.0 | 0.335 | 43.3 | 0.019 | 1.73 | 0.0400 | 0.057 |
| 0.0 | 0.549 | 41.8 | 0.041 | 3.04 | 0.0727 | 0.075 |
| 0.0 | 1.06 | 37.2 | 0.126 | 7.24 | 0.195 | 0.119 |
| 0.0 | 2.07 | 26.8 | 0.348 | 18.4 | 0.687 | 0.168 |
| 0.0 | 3.18 | 18.2 | 0.570 | 25.5 | 1.40 | 0.179 |
| 0.0 | 4.23 | 14.9 | 0.763 | 28.8 | 1.93 | 0.180 |
| 0.0 | 5.20 | 13.5 | 1.01 | 32.9 | 2.44 | 0.194 |
| 0.5 | 0.529 | 27.0 | ND[b] | 19.5 | 0.722 | — |
| 0.5 | 1.04 | 16.4 | ND | 30.4 | 1.85 | — |
| 0.5 | 2.05 | 11.8 | ND | 37.4 | 3.17 | — |
| 0.5 | 3.10 | 9.41 | ND | 39.4 | 4.19 | — |
| 0.5 | 4.14 | 7.44 | ND | 43.2 | 5.81 | — |
| 1.0 | 0.496 | 5.93 | 0.352 | 39.6 | 6.68 | 0.710 |
| 1.0 | 1.02 | 4.52 | 0.583 | 42.4 | 9.38 | 0.572 |
| 1.0 | 2.04 | 5.21 | 0.882 | 45.1 | 8.66 | 0.432 |
| 1.0 | 3.14 | 6.77 | 1.11 | 38.8 | 5.73 | 0.354 |
| 1.0 | 4.04 | 6.29 | 1.18 | 41.2 | 6.55 | 0.292 |

[a]with extractant prepared by standard 48 hr-6M HCl-60 ° C purification of solvent batch No. 1.
[b]not determined

TABLE III

EQUILIBRIUM DATA FOR EXTRACTION OF PLUTONIUM AND $HNO_3$ BY 30% DHDECMP-$CCl_4$[a]

| Equilibrium Aqueous Phase | | | Equilibrium Organic Phase | | Distribution Ratios | |
|---|---|---|---|---|---|---|
| $Al(NO_3)_3$ M | $HNO_3$ M | Pu mg/ml (× $10^4$) | $HNO_3$ M | Pu mg/ml (× $10^4$) | $D_{Am}$ | $D_{HNO_3}$ |
| 0.0 | 0.144 | 238. | 0.0020 | 362. | 1.52 | 0.014 |
| 0.0 | 0.264 | 75.7 | 0.014 | 535. | 7.07 | 0.053 |
| 0.0 | 0.530 | 18.4 | 0.039 | 618. | 33.6 | 0.074 |
| 0.0 | 1.03 | 5.35 | 0.138 | 592. | 111. | 0.134 |
| 0.0 | 2.08 | 3.02 | 0.386 | 602. | 199. | 0.186 |
| 0.0 | 3.20 | 2.76 | 0.618 | 612. | 222. | 0.193 |
| 0.0 | 4.34 | 1.56 | 0.832 | 612. | 392. | 0.192 |
| 0.0 | 4.86 | 1.27 | 1.04 | 726. | 542. | 0.214 |
| 0.05 | 0.548 | 8.31 | 0.137 | 2240 | 270. | 0.250 |
| 0.5 | 1.07 | 6.38 | 0.289 | 2350 | 368. | 0.270 |
| 0.5 | 2.03 | 5.58 | 0.525 | 2400 | 430. | 0.258 |
| 0.5 | 3.13 | 3.34 | 0.757 | 2340 | 700. | 0.242 |
| 0.5 | 4.16 | 2.83 | 0.963 | 2240 | 792. | 0.231 |
| 1.0 | 0.496 | 2.12 | 0.352 | 664. | 313. | 0.710 |
| 1.0 | 1.02 | 1.59 | 0.583 | 664. | 418. | 0.572 |
| 1.0 | 2.04 | 0.741 | 0.882 | 618. | 834. | 0.432 |
| 1.0 | 3.14 | 0.834 | 1.11 | 633. | 759. | 0.354 |
| 1.0 | 4.04 | 1.03 | 1.18 | 571. | 554. | 0.292 |
| 0.0[b] | 0.138 | 695. | 0.0097 | 0.332 | 0.000478 | 0.070 |
| 0.0[b] | 0.280 | 685. | 0.017 | 0.705 | 0.00103 | 0.061 |
| 0.0[b] | 0.542 | 690. | 0.046 | 3.25 | 0.00471 | 0.085 |
| 0.0[b] | 1.06 | 685. | 0.120 | 17.0 | 0.0248 | 0.113 |
| 0.0[c] | 0.179 | 715. | 0.0097 | 0.237 | 0.000331 | 0.054 |
| 0.0[c] | 0.327 | 690. | 0.014 | 1.37 | 0.00199 | 0.043 |
| 0.0 | 0.589 | 685. | 0.036 | 6.64 | 0.00971 | 0.061 |

TABLE III-continued

EQUILIBRIUM DATA FOR EXTRACTION OF PLUTONIUM AND $HNO_3$ BY 30% DHDECMP-$CCl_4$[a]

| Equilibrium Aqueous Phase | | | Equilibrium Organic Phase | | Distribution Ratios | |
|---|---|---|---|---|---|---|
| $Al(NO_3)_3$ M | $HNO_3$ M | Pu mg/ml (× $10^4$) | $HNO_3$ M | Pu mg/ml (× $10^4$) | $D_{Am}$ | $D_{HNO}$ |
| 0.0 | 1.26 | 669. | 0.109 | 34.3 | 0.0513 | 0.087 |

[a]with extractant purified by standard 48 hr-6M HCl-60 ° C purification of solvent batch No. 1.
[b]contained 0.1M HF.
[c]contained 0.05M HF.

TABLE IV

EQUILIBRIUM DATA FOR EXTRACTION OF AMERICIUM, PLUTONIUM, AND $HNO_3$ BY 30% DHDECMP-TCB[a]

| Equilibrium Aqueous Phase | | | Equilibrium Organic Phase | | | Distribution Ratios | | |
|---|---|---|---|---|---|---|---|---|
| $HNO_3$ M | Am μCi/ml | Pu mg/ml (× $10^4$) | $HNO_3$ M | Am μCi/ml | Pu mg/ml (× $10^4$) | $D_{Am}$ | $D_{Pu}$ | $D_{HNO\,3}$ |
| 0.147 | 35.5 | — | 0.0039 | 0.923 | — | 0.0260 | — | 0.027 |
| 0.302 | 53.5 | — | 0.014 | 1.55 | — | 0.0290 | — | 0.046 |
| 0.537 | 43.7 | — | 0.027 | 3.15 | — | 0.0721 | — | 0.050 |
| 1.04 | 46.2 | — | 0.087 | 8.94 | — | 0.194 | — | 0.084 |
| 2.01 | 22.9 | — | 0.286 | 22.7 | — | 0.991 | — | 0.142 |
| 3.14 | 13.6 | — | 0.446 | 30.7 | — | 2.26 | — | 0.142 |
| 4.18 | 12.4 | — | 0.500 | 34.2 | — | 2.76 | — | 0.120 |
| 5.74 | 11.3 | — | 0.613 | 33.7 | — | 2.98 | 13 | 0.107 |
| 0.171 | — | 1150. | 0.0044 | — | 426. | — | 0.370 | 0.026 |
| 0.298 | — | 633. | 0.011 | — | 870. | — | 1.37 | 0.037 |
| 0.558 | — | 239. | 0.030 | — | 1400. | — | 5.86 | 0.054 |
| 1.02 | — | 79.3 | 0.089 | — | 1710. | — | 21.6 | 0.087 |
| 1.98 | — | 27.6 | 0.270 | — | 1920. | — | 69.6 | 0.136 |
| 3.02 | — | 13.2 | 0.442 | — | 1900. | — | 144. | 0.146 |
| 4.04 | — | 10.9 | 0.607 | — | 1870. | — | 169. | 0.150 |
| 4.99 | — | 6.43 | 0.741 | — | 1320. | — | 205. | 0.148 |
| 0.099[b] | — | 695. | 0.0039 | — | 1.00 | — | 0.00144 | 0.040 |
| 0.254[b] | — | 695. | 0.014 | — | 2.10 | — | 0.00303 | 0.055 |
| 0.552[b] | — | 690. | 0.032 | — | 5.61 | — | 0.00813 | 0.058 |
| 1.08[b] | — | 609. | 0.093 | — | 20.9 | — | 0.0313 | 0.086 |
| 0.192[c] | — | 669. | 0.0059 | — | 1.77 | — | 0.00265 | 0.030 |
| 0.346[c] | — | 674. | 0.012 | — | 4.31 | — | 0.00639 | 0.035 |
| 0.594[c] | — | 674. | 0.031 | — | 11.1 | — | 0.0165 | 0.052 |
| 1.11[c] | — | 649. | 0.090 | — | 49.4 | — | 0.0763 | 0.081 |

[a]with extractant purified by standard 48 hr-6M HCl-60 ° C purification scheme.
[b]contained 0.1M HF.
[c]contained 0.05M HF.

From these data DHDECMP was found to extract Pu(IV) more strongly than Am(III). In particular, at 0.14 M $HNO_3$, the ratio of distribution ratios for plutonium and americium ($D_{Pu}/D_{Am}$) for 30% DHDECMP-$CCl_4$ was about 100; the separation coefficient was high enough to permit partitioning of Pu(IV) from Am(III) in a countercurrent system.

Extraction of Pu(VI) and Am(III) by 30% DHDECMP-$CCl_4$ from $HNO_3$ media was found to increase with additional $Al(NO_3)_3$. With one or two exceptions, data for extraction of plutonium and americium from $HNO_3$—$Al(NO_3)_3$ solutions correlated fairly well with the ionic strength of the solutions.

Dilute (0.1 M) $HNO_3$ solutions containing about 0.1 M HF were found to readily strip Pu(IV) from DHDECMP extractant (see Table III).

EXAMPLE II

A number of multiple batch runs were carried out to test certain flowsheet features. In one run actual acidic aqueous waste (CAW) solution (20 ml) was contacted three times with fresh equal-volume portions of 30% DHDECMP-$CCl_4$ which had been previously equilibrated with a 2 M $HNO_3$ — 0.75 M $Al(NO_3)_3$ solution. These three extraction contacts were found to remove better than 99% of the $^{241}Am$ and > 99.9% of the plutonium from the CAW solution.

In another run multiple batch contracts were performed to study the performance of the Am/Pu partition step at various aqueous:organic (A/O) flow ratios. A number of extractants comprising 30 volume % DHDECMP-$CCl_4$ (or TCB) which had previously been equilibrated twice with fresh equal volume portions of 2 M $HNO_3$ — 0.75 M $Al(NO_3)_3$ were contacted with equal volumes of 2 M $HNO_3$ — 0.75 M $Al(NO_3)_3$ solution containing either 0.05 g/liter Pu or 0.01 g/liter Am. Portions of the resultant solvents were then contacted three times with fresh portions of 0.1 M $HNO_3$ at various volume ratios. The results are given in Table V below:

TABLE V

PARTITION COLUMN: MULTIPLE BATCH STUDIES

| | Percent Stripped | | | |
|---|---|---|---|---|
| | Am | | Pu | |
| A/O | $CCl_4$ | TCB | $CCl_4$ | TCB |
| 0.67 | — | — | 9.88 | 26.1 |
| 0.50 | >99.7 | >99.7 | 7.75 | 31.5 |
| 0.33 | 99.5 | 99.4 | 6.86 | 18.5 |

[a]in three contacts.

Thus it will be seen at A/O's of 0.07 to 0.33 three successive batch contacts with fresh portions of 0.1 M $HNO_3$ readily stripped over 99% of the americium and less than 10% of the plutonium. Such contacts, however, were found to strip considerably more plutonium from 30% DHDECMP-TCB solvent reflecting the lower plutonium distribution ratios for DHDECMP-TCB solvents.

EXAMPLE III

Several runs (Table VI) were made in mixer-settler equipment under counter current conditions using 30% DHDECMP and feed stock of actual acidic aqueous waste (CAW) solutions. The mixer-settler had four stages in each run.

TABLE VI

MIXER-SETTLER FLOWSHEET TESTS: EXTRACTION COLUMN

| Extractant Carrier Solvent | Cycles Used[a] | Flow Ratio A/O[b] | $HNO_3$, M Organic Product | $HNO_3$, M Aqueous Waste | Losses to Aqueous Waste Pu, % | Losses to Aqueous Waste Am, % |
|---|---|---|---|---|---|---|
| TCB | 0 | 2 | 0.504 | 1.97 | 0.46 | 12.7 |
| TCB | 0 | 1 | 0.486 | 1.77 | 0.41 | 8.8 |
| TCB | 1 | 1 | 0.485 | 1.77 | 0.52 | 5.7 |
| $CCL_4$ | 0 | 0.67 | 0.673 | 1.47 | 0.38 | — |
| $CCL_4$ | 0 | 0.67 | 0.673 | 1.50 | 0.19 | 6.6 |
| TCB | 3 | 0.50 | 0.472 | 1.35 | 0.61 | 1.7 |
| TCB | 4 | 0.50 | 0.555 | 1.33 | — | 1.6 |

[a]refers to number of previous mixer-settler runs made with this extractant.
[b]aqueous/organic flow ratio.

From the data it may be seen that americium recovery increased with increased extractant flow and exceeded 90% at aqueous:organic flow ratios $\leq$ 1. Over the range of conditions tested, however, plutonium was insensitive to changes in aqueous:organic flow ratio and exceeded 99% in all runs.

A number of feed solutions comprising 30% DHDECMP solvents containing ~ 0.005 g/liter Pu from the extraction column, supra, were passed into a partitioning column (three stages) to determine the effectiveness of stripping the extracted Am/Pu values from the organic phase by dilute (0.1 M) $HNO_3$. The various data are given in Table VII below.

TABLE VII

MIXER-SETTLER FLOWSHEET TESTS: PARTITION COLUMN RUNS

| Carrier Solvent | Flow Ratio A/O[a] | $HNO_3$, M STF | $HNO_3$, M STP | $HNO_3$, M STW | Percent in Aqueous Am | Percent in (SIP) Pu | Percent in Organic Am | Percent in (SIW) Pu |
|---|---|---|---|---|---|---|---|---|
| $CCl_4$ | 0.67 | 0.542 | 0.853 | 0.030 | 89.4 | — | 4.61 | — |
| $CCl_4$ | 0.67 | 0.475 | 0.718 | 0.035 | 90.8 | 31.9 | 4.05 | 77.8 |
| $CCl_4$ | 0.67 | 0.673 | 0.920 | 0.018 | 80.6 | 2.4 | 2.1 | 116.0 |
| TCB[b] | 0.67 | 0.665 | 1.17 | 0.011 | — | 50.7 | — | 55.8 |
| $CCl_4$* | 0.50 | 0.565 | 1.01 | 0.065 | 83.7 | — | 16.4 | — |
| $CCl_4$ | 0.30 | 0.500 | 1.44 | 0.092 | 80.0 | — | 28.0 | 91.6 |
| $CCl_4$ | 0.30 | 0.680 | 1.72 | 0.137 | — | 8.3 | — | 95 |

[a]aqueous/organic = S1F/S1X
[b]four stages
*Impurity content of the Am product solution from this run listed in Table IX.

From this data three mixer-settler stages at aqueous:organic flow ratio of 0.3 stripped 80% of the Am and less than 10% of the Pu from the organic phase. The partition column at A/O of 0.33 should thus provide adequate stripping (75-80%) of the Am accompanied by only 5–10% of the plutonium.

A number of feed solutions comprising 30% DHDECMP solvents containing ~ 0.005 g/liter Pu and ~ $10^4$ g/liter Am from the partitioning column, supra, were passed into a stripping column to determine the effectiveness of stripping the Pu from the organic phase into dilute (0.1 M) $HNO_3$ — HF. The various data are given in Table VIII below:

TABLE VIII

MIXER-SETTLER FLOWSHEET TESTS: PU-STRIP COLUMN RUNS

| Carrier Solvent | Flow Ratio A/O[a] | Stages | $HNO_3$M S2F | $HNO_3$M S2P | $HNO_3$M S2W | Percent not Stripped Pu | Percent not Stripped Am |
|---|---|---|---|---|---|---|---|
| $CCl_4$ | 0.08 | 3 | 0.029 | 0.308 | 0.013 | 33.9 | 11.9 |
| $CCl_4$ | 0.16 | 3 | 0.032 | 0.292 | 0.007 | 21.4 | — |
| $CCl_4$ | 0.16 | 3 | 0.091 | 0.689 | 0.019 | 32.1 | 6.3 |
| $CCl_4$ | 0.16 | 3 | 0.064 | 0.478 | 0.010 | 29.6 | — |
| TCB | 0.16 | 4 | 0.023 | 0.340 | 0.005 | 8.7 | — |
| $CCl_4$ | 0.16 | 4 | 0.016 | 0.238 | 0.010 | 40.4 | 4.2 |

[a]aqueous/organic = S2F / S2W

From these data the stripping of the Pu from the DHDECMP extractant was generally unsuccessful. The distribution ratio, however, supplemented by results of multiple batch contacts establish that dilute $HNO_3$ — HF solutions readily strip plutonium from DHDECMP extractants. Residual plutonium in the organic waste stream from these mixer-settler runs was readily removed by batch-contacting them with equal volumes of 0.1 M $HNO_3$ — 0, 1 M HF. It is thus concluded that while plutonium is readily stripped batch-wise from DHDECMP extractants with dilute $HNO_3$ — HF for mixer-settler operations the plutonium strip column should employ higher aqueous: organic flow ratios and possibly higher HF concentrations.

EXAMPLE III

A comparison was made between the impurity level of the major impurities in Am product produced in a typical mixer-settler using DHDECMP with process partition column run and a recent plant-scale operation with DBBP extraction process. The data are given in Table IX below:

TABLE IX

IMPURITY CONTENT OF AMERICIUM PRODUCT SOLUTIONS

| Component | Concentration, mg/liter[a] DHDECMP Process Product[b] | Concentration, mg/liter[a] Plant DBBP Process Product[c] |
|---|---|---|
| Al | 30 | 33 |
| Na | 11 | 30 |
| Si | 10 | 6 |
| Fe | 5 | 11 |
| Ca | 4 | 25 |
| Mg | 1 | 4 |
| Ni | 2 | 2 |

TABLE IX-continued

IMPURITY CONTENT OF AMERICIUM PRODUCT SOLUTIONS

| Component | Concentration, mg/liter[a] | |
|---|---|---|
| | DHDECMP Process Product[b] | Plant DBBP Process Product[c] |
| Cr | ND[d] | 1 |

[a]determined by atomic absorption techniques.
[b]from mixer-settler partition column run marked with asterisk in Table VII.
[c]grab sample taken in July 1974.
[d]not determined.

From these data it is apparent that the DHDECMP process yields americium product of purity comparable to or, on some counts, superior to that of the DBBP process. It is recognized that the particular plant sample referred to here may have been taken when the DBBP process produced atypically pure product, if so, the capability of the DHDECMP process to produce high-quality americium product is further emphasized.

The detailed description hereinbefore given is intended to be illustrative only. Obviously many variations may be provided by those skilled in the art for providing for the extraction and partitioning of Am/Pu or all of the actinides from acidic aqueous waste solutions with the present process without departing from the intended scope of this invention.

It is therefore to be understood that the scope of the present invention is to be determined only in accordance with what is claimed in the appended claims.

What is claimed is:

1. A liquid-liquid extraction process for the recovery and partitioning of actinide values selected from the group consisting of Am (III), Cm (III), Pu (IV), Np (IV) and U (VI), from acidic nuclear waste aqueous solutions comprising the steps of contacting said aqueous solutions with a bidentate organophosphorous extractant selected from the group consisting of methylene diphosphonates, carbamylphosphonates, and carbamylmethylene diphosphonates to thereby extract said actinide values into the organic phase, contacting said actinide-loaded organic phase with an aqueous dilute about 0.1M nitric acid solution to extract the trivalent actinide values into the aqueous phase, contacting the organic phase containing the tetravalent and hexavalent actinide values with an aqueous solution of about 0.1M nitric-hydrofluoric acid to thereby extract the tetravalent actinide values into the aqueous phase and thereafter contacting the organic phase containing the hexavalent actinide values with a dilute solution of sodium carbonate to thereby remove the hexavalent actinide values from said organic phase.

2. The method of claim 1 wherein said bidentate organophosphorus extractant comprises dihexyl-N, N-diethylcarbamylmethylene phosphonate.

3. The method of claim 1 wherein said bidentate organophosphorus extractant comprises dihexyl-N, N-diethylcarbamylmethylene phosphonate dissolved in dodecane diluent.

4. The method of claim 3 wherein said dihexyl-N, N-diethylcarbamylmethylene phosphonate-dodecane extractant comprises 10% by volume dihexyl-N, N-diethylcarbamylmethylene phosphonate.

5. The method of claim 1 wherein said acidic nuclear waste aqueous solution comprises Purex high-level acidic aqueous solution having a nitric acid of about 5 M.

6. The method of claim 1 wherein said extraction steps are carried out batch wise.

7. The method of claim 1 wherein said extraction steps are carried out in a mixer-settler.

8. The method of claim 1 wherein said actinide values are present in a concentration range of 0.1 to 10 g/liter.

9. The method of claim 1 wherein the dilute nitric acid solution containing the trivalent actinides is passed through a pressurized ion exchange column to recover an Am-Cm portion and purify it from trivalent lanthanides.

10. The method of claim 1 wherein said dilute aqueous solution of nitric acid - hydrofluoric acid containing the tetravalent actinides is passed to an anion exchange column to recover Np(IV) - Pu(IV) fraction.

11. The method of claim 1 wherein said acidic nuclear waste aqueous solution comprises approximately 2 M nitric acid, said actinide values comprise Am(III) and Pu(IV) in a concentration of approximately 0.005 to 0.01 g/liter, said bidentate organophosphorus extractant comprises a 30% by volume solution of dihexyl-N, N-diethylcarbamylmethylene - carbon tetrachloride and said extraction steps are carried out by first extracting said Am(III) and Pu(IV) values into said organic phase, contacting the resulting Am(III) - Pu(IV) - loaded organic phase with about 0.1 M nitric acid to strip approximately 90% of the Am(III) and 10% of the Pu(IV) into the aqueous phase, contacting the Pu(IV) - loaded organic phase with about 0.1 M $HNO_3$ — HF solution to strip approximately 90% of the Pu(IV) into the aqueous phase and recycling the organic phase to said extraction step.

12. The method of claim 1 wherein said contacting of said acidic nuclear waste aqueous solutions with said bidentate organophosphorous extractant extracts at least 90% of said Am (III), at least 99% of said Cm (III), at least 95% of said Pu (IV), at least 95% of said Np (IV), and at least 99% of said U (VI) into said organic phase; at least 80% of the Am (III) values and at least 99% of the Cm (III) values are extracted from said organic phase by said contacting of said actinide loaded organic phase with said about 0.1M nitric acid solution; at least 90% of said Pu (IV) value and at least 95% of said Np (IV) are extracted from said organic phase during said contacting of the organic phase containing said tetravalent and hexavalent actinide values with an about 0.1M nitric-hydrofluoric acid solution.

* * * * *